US008900038B2

(12) United States Patent
Erickson

(10) Patent No.: US 8,900,038 B2
(45) Date of Patent: Dec. 2, 2014

(54) SANDING APPARATUS FOR REMOVING RUNS AND DRIPS

(71) Applicant: Timothy Wayne Erickson, Bismark, ND (US)

(72) Inventor: Timothy Wayne Erickson, Bismark, ND (US)

( * ) Notice: Subject to any disclaimer, the term of this patent is extended or adjusted under 35 U.S.C. 154(b) by 129 days.

(21) Appl. No.: 13/768,358

(22) Filed: Feb. 15, 2013

(65) Prior Publication Data

US 2014/0235149 A1 Aug. 21, 2014

(51) Int. Cl.
*B24D 15/02* (2006.01)

(52) U.S. Cl.
CPC ..... *B24D 15/023* (2013.01)
USPC ..... 451/523; 451/521; 451/522; 451/525

(58) Field of Classification Search
CPC ..... B24D 15/023; B24D 15/04; B24D 11/00; B24D 15/00
USPC ..... 451/520, 521, 522, 523, 525
See application file for complete search history.

(56) References Cited

U.S. PATENT DOCUMENTS

| | | | | | |
|---|---|---|---|---|---|
| 932,879 | A | * | 8/1909 | May | 451/502 |
| 952,186 | A | * | 3/1910 | Courtois | 451/522 |
| 1,012,479 | A | * | 12/1911 | Thomas | 451/503 |
| 1,681,648 | A | * | 8/1928 | Root | 451/522 |
| 1,722,183 | A | * | 7/1929 | Thomas | 451/522 |
| 1,921,211 | A | * | 8/1933 | Bawden | 451/519 |
| 1,948,403 | A | * | 2/1934 | Thomas | 451/503 |
| 2,743,558 | A | * | 5/1956 | Hagadorn | 451/493 |
| 2,818,690 | A | * | 1/1958 | Pritikin | 451/491 |
| D260,357 | S | * | 8/1981 | Brannan | D8/94 |
| 4,930,267 | A | * | 6/1990 | Hill et al. | 451/354 |
| 5,944,586 | A | * | 8/1999 | Sevigny et al. | 451/57 |
| 6,213,861 | B1 | * | 4/2001 | Gunn | 451/557 |
| 6,634,937 | B1 | * | 10/2003 | Edwards et al. | 451/502 |
| 2012/0270482 | A1 | * | 10/2012 | Comstock et al. | 451/525 |
| 2013/0109284 | A1 | * | 5/2013 | Andonian | 451/495 |

* cited by examiner

*Primary Examiner* — George Nguyen

(57) ABSTRACT

A sanding apparatus for removing runs and drips in paint includes a base member, an oscillating member, and a connector bolt. The oscillating member is positioned within the base member where the base member and the oscillating member are movably connected to each other by the connector bolt. A sanding paper can be securely positioned with the oscillating member in order to sand down the runs and drips. The connector bolt allows users of the sanding apparatus to move the oscillating member up and down so that different size runs and drips can be removed from the paint without damaging the surrounding areas of the paint.

20 Claims, 9 Drawing Sheets

SANDING APPARATUS FOR REMOVING RUNS AND DRIPS

FIELD OF THE INVENTION

The present invention relates generally to a sanding apparatus. More specifically, the present invention allows a user to sand down only runs and drips in paint without damaging the surrounding areas of the runs and drips.

BACKGROUND OF THE INVENTION

Runs and drips in paint are a common problem with an automotive painting or any other type of painting processes. As for the automotive paint process, when the applied paint is dried, the excess runs and drips on the paint surface protrude out from the paint surface. In order to complete the paint process, the runs and drips have to be sand down so that the paint surface is smooth and even. Often times, a sharp blade or a sand paper is used by painters to remove the runs and drips. Even though the sharp blade and the sanding paper remove the runs and drips in the paint, surrounding areas of the runs and drips may get damage during the process causing to repaint the surrounding area.

As a solution, the present invention provides a sanding apparatus which allows the painters to sand down only the runs and drips of the paint preventing paint brake though and repainting. Different grit sized sand papers can be secured within the present invention's movable plate, and the movable plate allows the present invention to sand down different sized and shaped runs and drips. Since the present invention does not damage the surrounding areas of the runs and drips, the present invention saves time and money while improving the painting process.

DETAIL DESCRIPTIONS OF THE INVENTION

All illustrations of the drawings are for the purpose of describing selected versions of the present invention and are not intended to limit the scope of the present invention.

Figure 1:
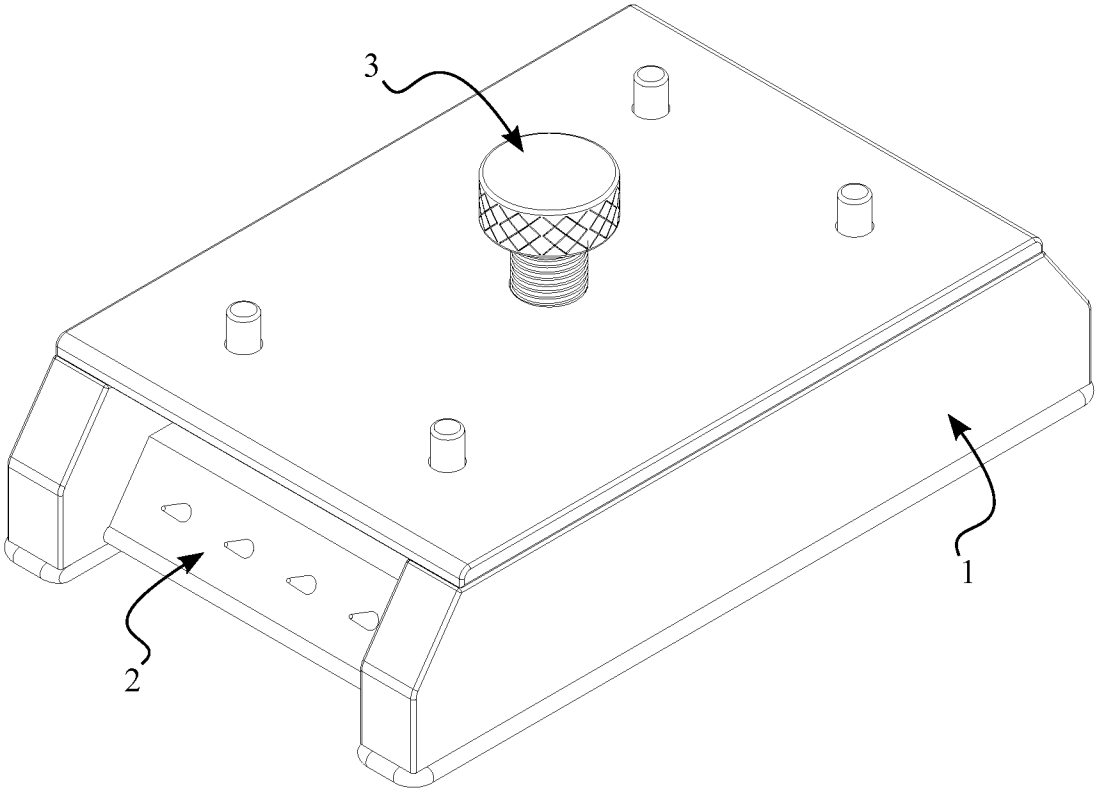
FIG. 1 is a perspective view of the present invention.

The present invention is a sanding apparatus for removing runs and drips in paint where the present invention comprises a base member 1, an oscillating member 2, and a connector bolt 3. In reference to FIG. 1, the oscillating member 2 is positioned within the base member 1, and the base member 1 and oscillating member 2 are connected to each other by the centrally positioned connector bolt 3. The base member 1 allows the users to securely hold the present invention, and the oscillating member 2 secures a sanding paper so that the runs and drips can be sanded down. The connector bolt 3 allows the users to adjust the height of the oscillating member 2 so that precision sanding can be achieved only for the runs and drips without damaging the surrounding paint areas.

Figure 3:
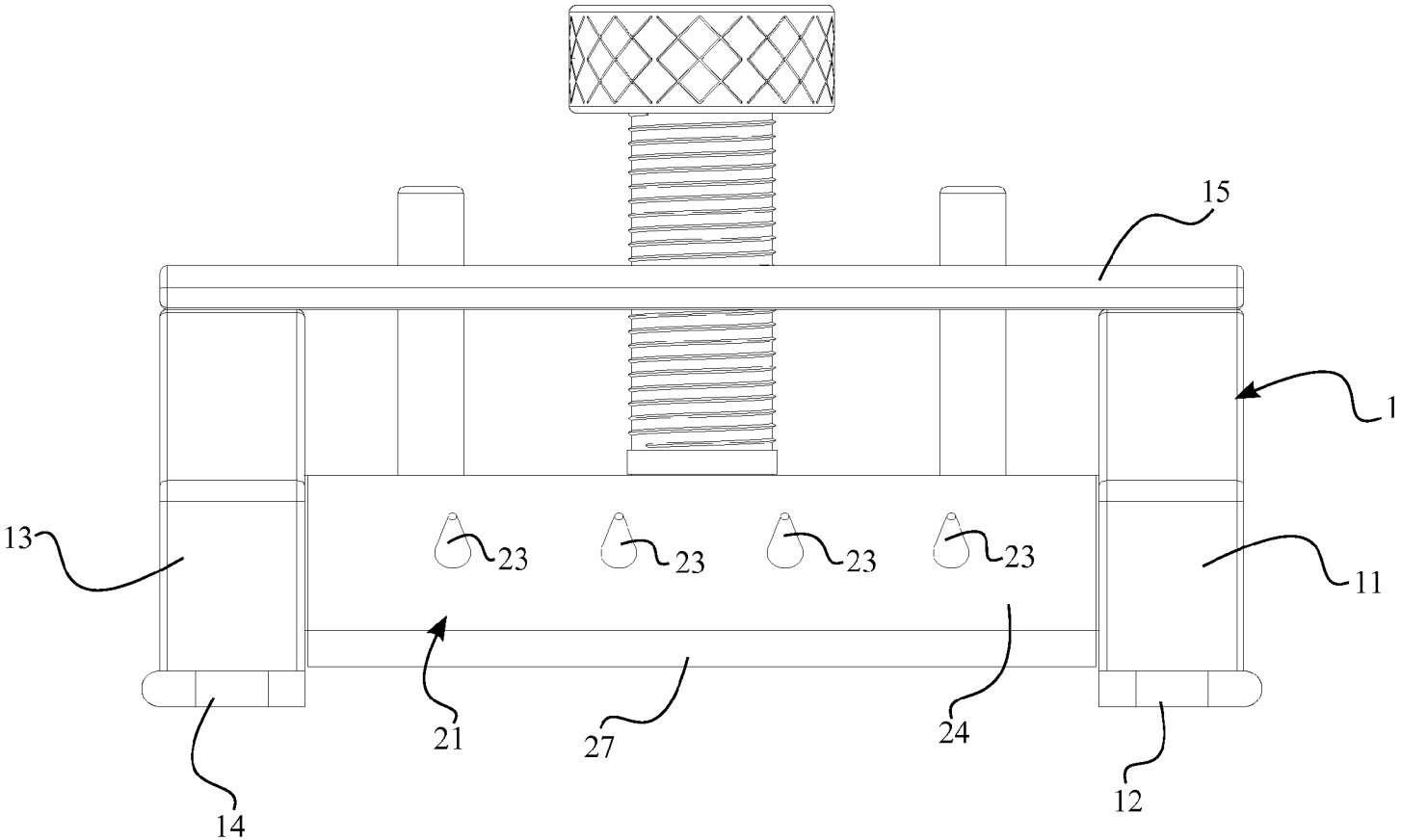
FIG. 3 is a back view of the present invention.
Figure 4:
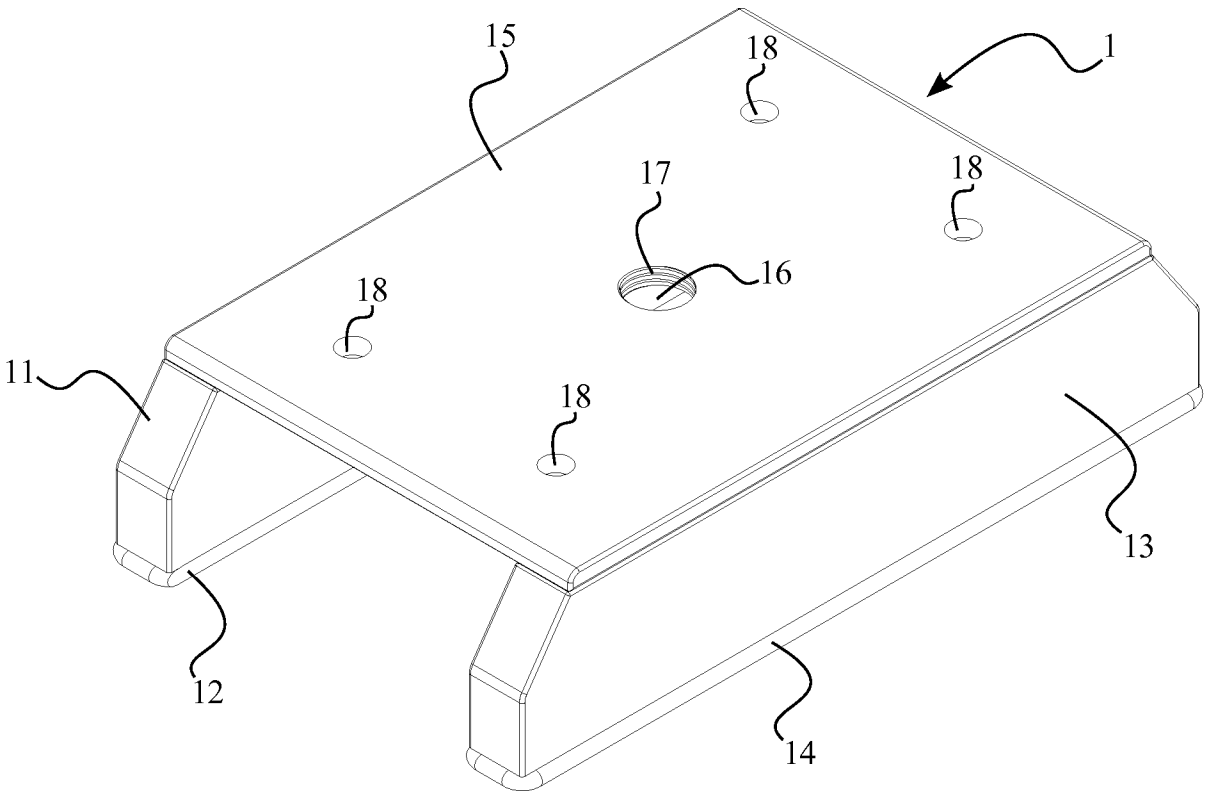
FIG. 4 is a perspective view of a base member of the present invention where a middle scratch-resistant layer is not shown.

In reference to FIG. 4, the base member 1 of the preferred embodiment comprises a first side rail 11, a second side rail 13, a rail connector plate 15, a hole 16, a female screw thread 17, and a plurality of pin holes 18. The first side rail 11 and the second side rail 13 are oppositely positioned from each other and perpendicularly connected with the rail connecter plate, where the rail connector plate 15 is positioned atop the first side rail 11 and the second side rail 13. In reference to FIG. 2 and FIG. 3, when the first side rail 11 and the second side rail 13 are perpendicularly connected to the rail connector plate 15, the base member 1 is shaped as an upside down U-shape. The first side rail 11, the second side rail 13, and the rail connector plate 15 of the preferred embodiment each comprises general rectangular shape structure, but are not limited only to the rectangular shape structure and can be any other geometric shapes. The shape of the first side rail 11 and the second side rail 13 are identical to each other so that the rail connector plate 15 can be perfectly leveled along the first side rail 11 and the second side rail 13. The resting surface is a painted surface with runs and drips where the present invention is placed in order to sand down the runs or drips. The first side rail 11 and the second side rail 13 evenly place the present invention on top of the resting surface where the rail connector plate 15 positions parallel with the resting surface. The first side rail 11, the second side rail 13, and the rail connector plate 15 can be made from, but is not limited to, steel, hard plastic, aluminum or any other type of high strength materials.

In reference to FIG. 4, the first side rail 11 and the second side rail 13 respectively comprise a first scratch-resistant layer 12 and a second scratch-resistant layer 14. The first scratch-resistant layer 12 is oppositely positioned from the rail connector plate 15 and securely connected to the first side rail 11. The second scratch-resistant layer 14 is also oppositely positioned from the rail connector plate 15 and securely connected to the second side rail 13. The first scratch-resistant layer 12 and the second scratch-resistant layer 14 can be made from any kind of scratch resistant materials such as rubber or coated polyethylene. When the first side rail 11 and the second side rail 13 are placed over the resting surface, the first scratch-resistant layer 12 and the second scratch-resistant layer 14 protect the resting surface from the first side rail 11 and the second side rail 13 so that unnecessary scratches can be avoided. Each of the first side rail 11 and the second side rail 13 further comprises a pair of keyways. The pair of keyways of the first side rail 11 and the pair of keyways of the second side rail 13 are oppositely positioned from each other within the inner walls of the first side rail 11 and the second side rail 13. The pair of keyways of the first side rail 11 extends from the first scratch-resistant layer 12 to the rail connector plate 15, and the pair of keyways of the second side rail 13 extends from the second scratch-resistant layer 14 to the rail connector plate 15.

As shown in the FIG. 4, the hole 16 is centrally traversed through the rail connector plate 15. The female screw thread 17 is spirally positioned within the hole 16 where the female screw thread 17 is adjacently traversed into a cylindrical wall of the hole 16. The plurality of pin holes 18 are positioned around the hole 16 and adjacently positioned with each corner of the rail connector plate 15, where the plurality of pin holes 18 is traversed through the rail connector plate 15.

Figure 2:
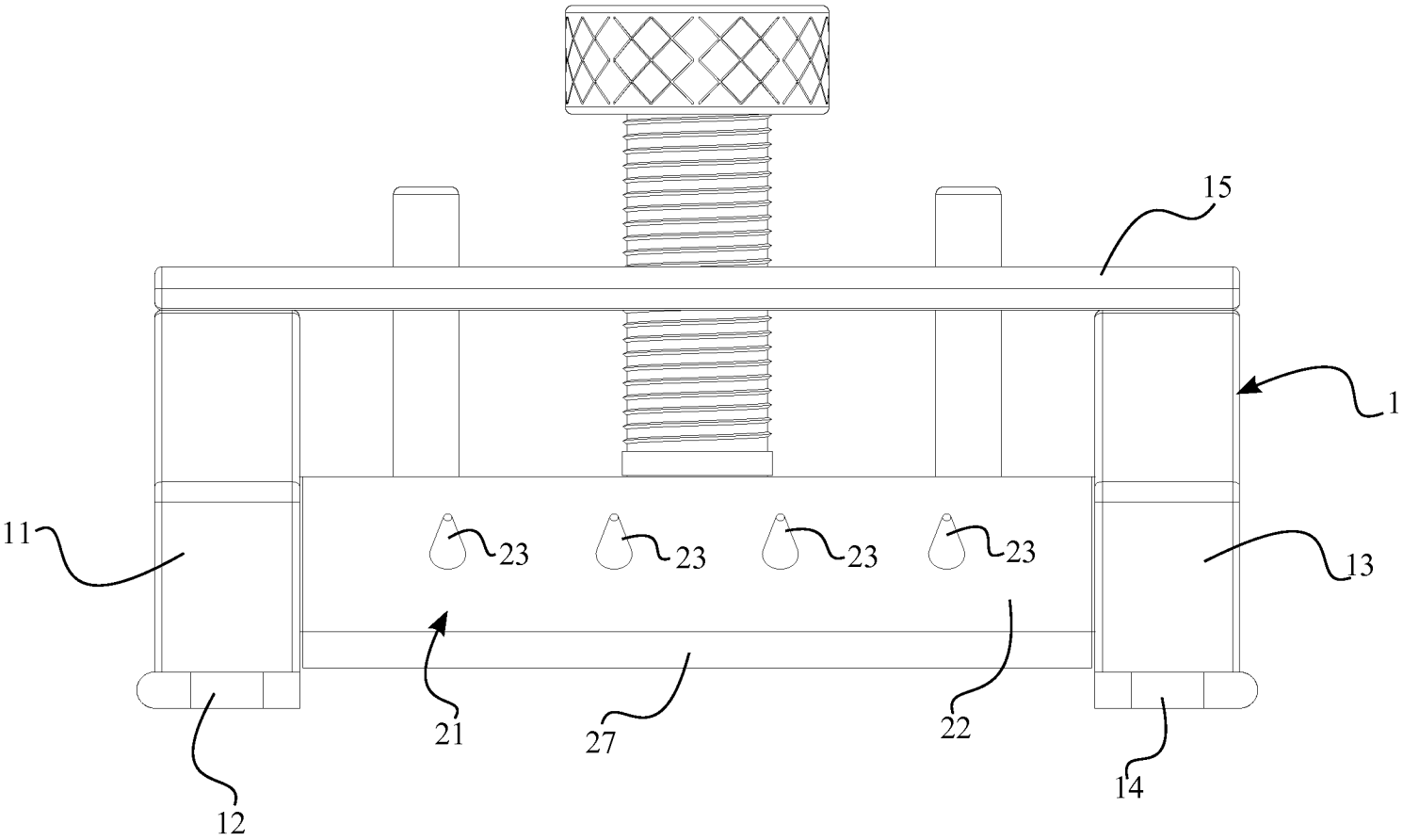
FIG. 2 is a front view of the present invention.
Figure 5:
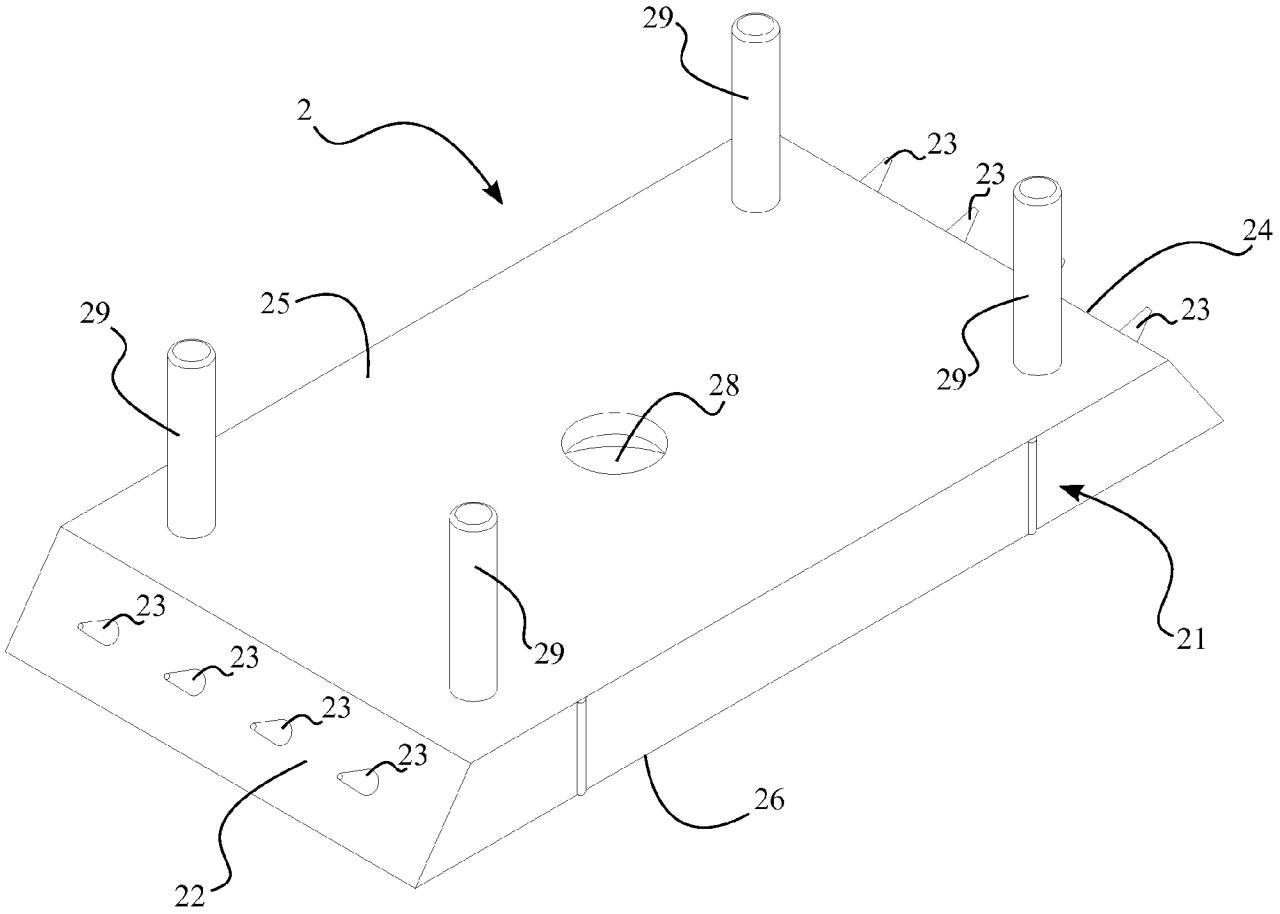
FIG. 5 is a perspective view of an oscillating member of the present invention.
Figure 9:
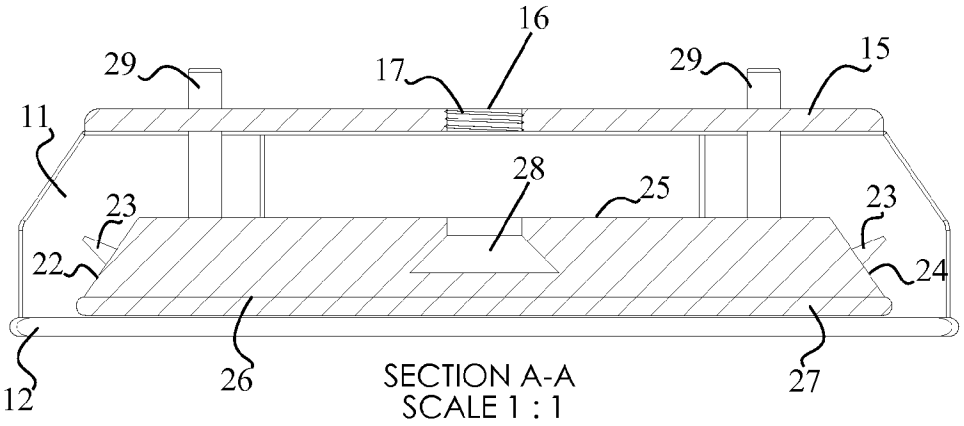
FIG. 9 is a cross section view of the present invention taken along line A-A of FIG. 8.
Figure 8:
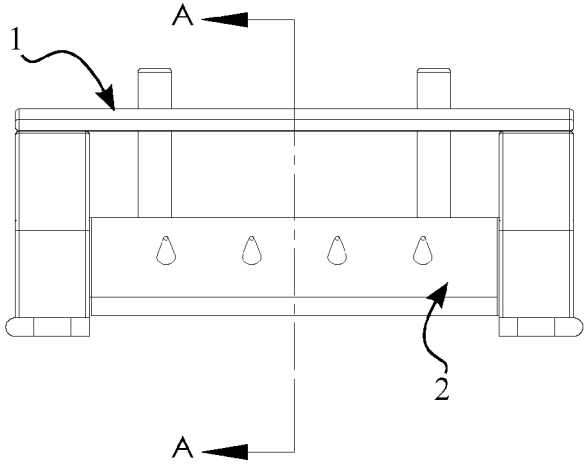
FIG. 8 is a front view of the present invention, showing the plane upon which a cross sectional view is taken shown in FIG. 9.

In reference to FIG. 2 and FIG. 5, the oscillating member 2 of the referred embodiment comprises a bottom plate 21, a middle scratch-resistant layer 27, a bolt rotational cavity 28, and a plurality of position pins 29. The bottom plate 21 is positioned in between the first side rail 11, the second side rail 13, and the rail connector plate 15. The bottom plate 21 of the preferred embodiment comprises a rectangular shaped, but the bottom plate 21 is not limited only to the rectangular shape and can be any other geometric shapes. The bottom plate 21 comprises two lateral walls, a front end 22, a back end 24, a top surface 25, and a bottom surface 26. The top surface 25 is positioned adjacent with the rail connector plate 15, and the bottom surface 26 is positioned opposite from the top surface 25. The front end 22 and the back end 24 are angularly positioned in between the top surface 25 and the bottom surface 26 where the top surface 25 has a shorter length than the bottom surface 26. Each of the lateral walls comprises a pair of protrusions, where the pair of protrusions extends from the top surface 25 to the bottom surface 26. The front end 22 and the back end 24 each comprise a plurality of sinkers 23. The plurality of sinkers 23 is equally spaced and perpendicularly connected to the front end 22 and the back end 24. The middle scratch-resistant layer 27 is adjacently connected to the bottom surface 26. The middle scratch-resistant layer 27 can be made from any kind of scratch resistant materials, such as rubber or coated polyethylene, so that bottom surface 26 does not get in contact with the resting surface. The sanding paper positions below the middle scratch-resistant layer 27 and extend from either the front end 22 to the back end 24 or the back end 24 to the front end 22. When the sanding paper is adjacently placed with the middle scratch-resistant layer 27, the plurality of sinkers 23 is traversed through the sanding paper from the front end 22 and the back end 24, where the plurality of sinkers 23 secures the sanding paper to the bottom plate 21. The bottom plate 21 and the plurality of sinkers 23 can be made from, but is not limited to, steel, hard plastic, aluminum or any other type of high strength materials In reference to FIG. 8 and FIG. 9, the bolt rotational cavity 28 is centrally positioned on the top surface 25, and the bolt rotational cavity 28 is vertically and concentrically aligned with the hole 16. The bolt rotational cavity 28 comprises a top cylindrical section and a bottom conical section where both sections are seamlessly connected to each other. The top cylindrical section expands from a top diameter of the bolt rotational cavity 28 to a middle diameter of the bolt rotational cavity 28 where the top diameter and the middle diameter are identical to each other. The bottom conical section expands from the middle diameter to a bottom diameter of the bolt rotational cavity 28 where the bottom diameter is bigger than the middle diameter.

Figure 6:
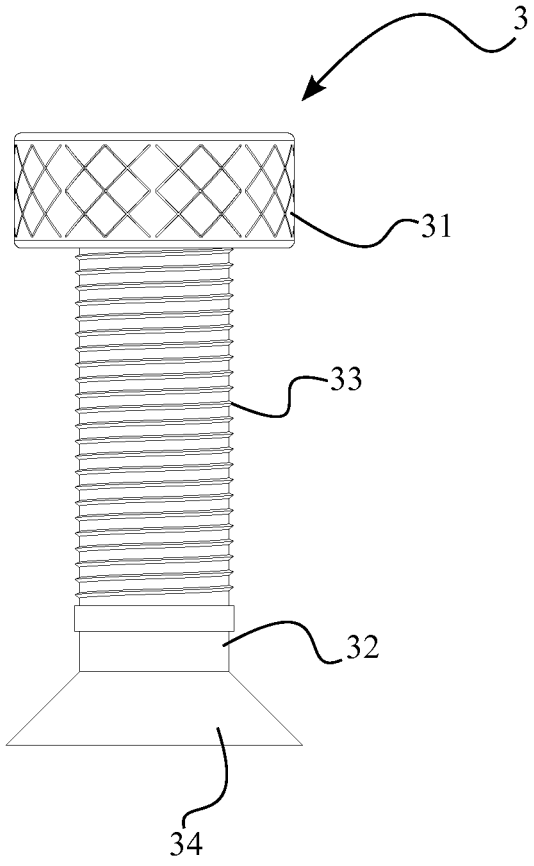
FIG. 6 is a front view of a connector bolt of the present invention.
Figure 7:
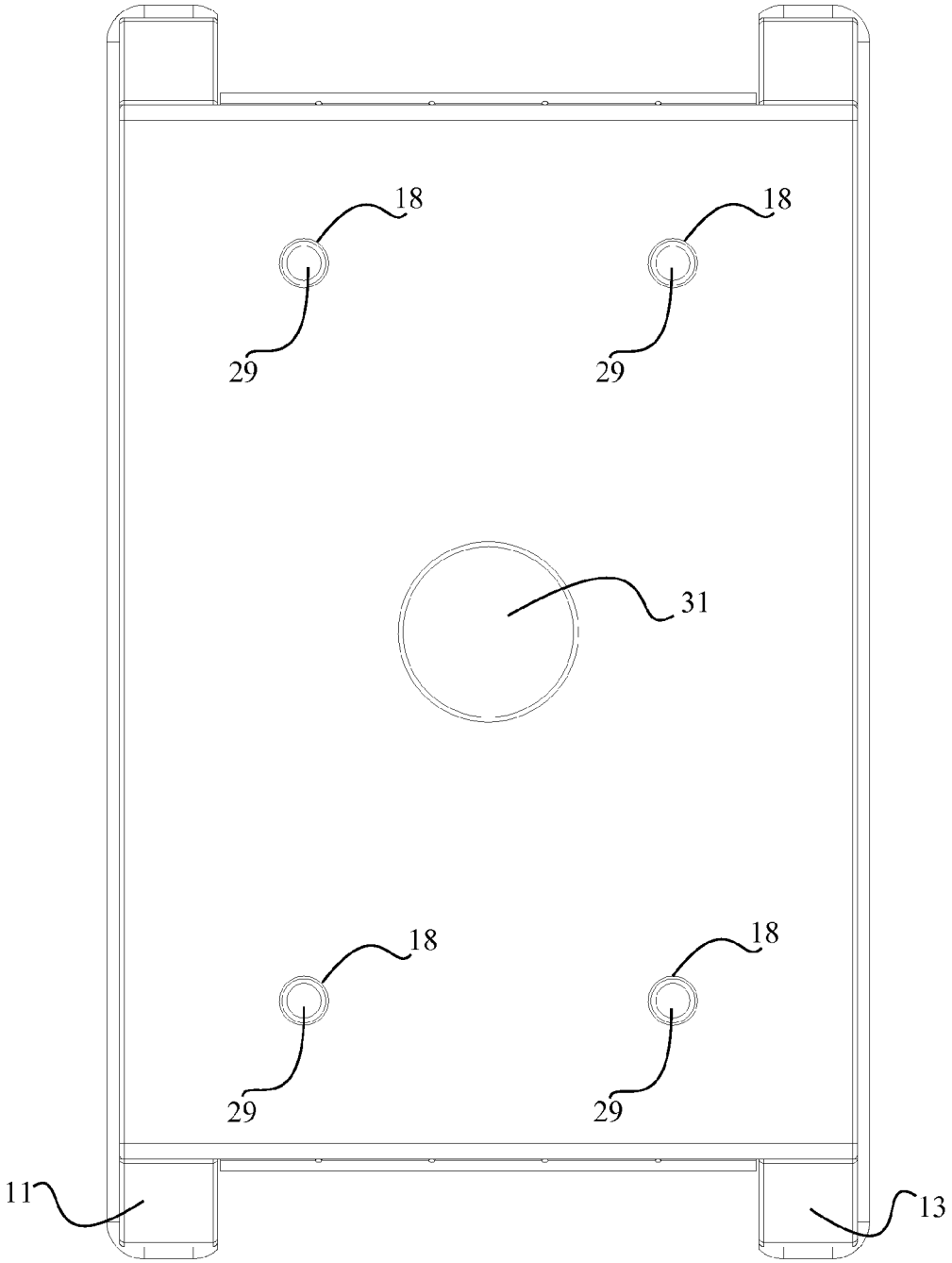
FIG. 7 is a top view of the present invention.
Figure 11:
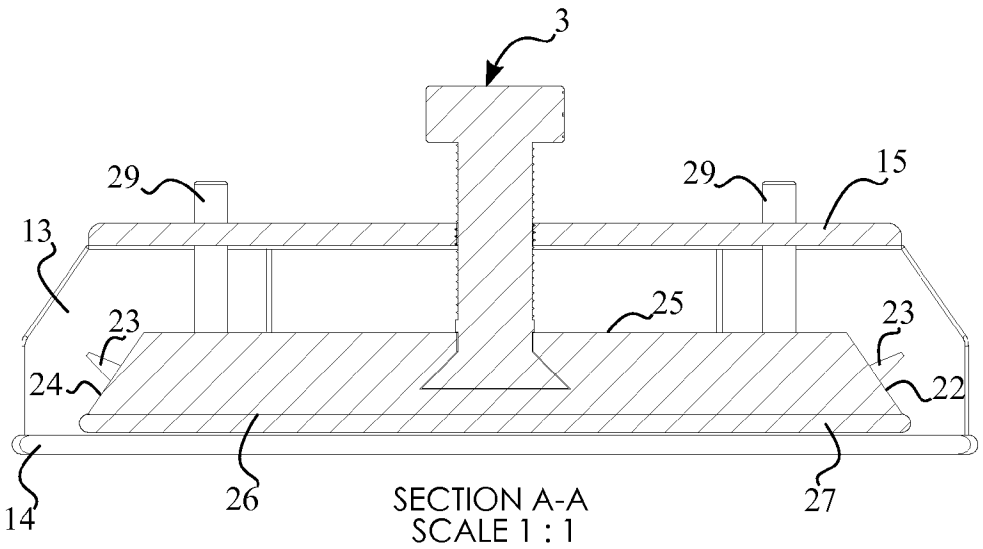
FIG. 11 is a cross section view of the present invention taken along line A-A of FIG. 10.
Figure 10:
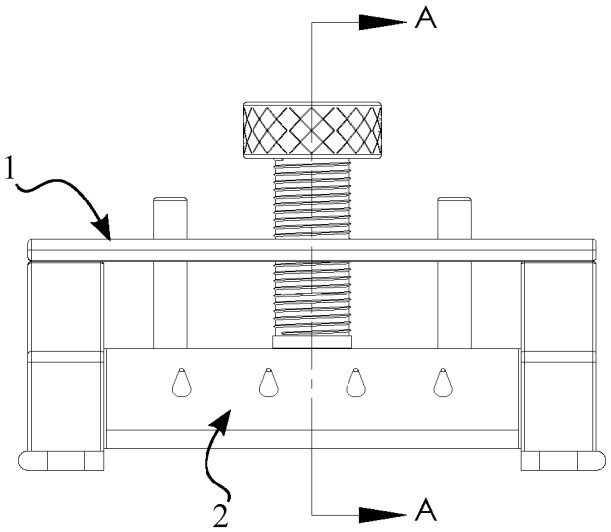
FIG. 10 is a front view of the present invention, showing the plane upon which a cross sectional view is taken shown in FIG. 11.

In reference to FIG. 7, the plurality of position pins 29 is perpendicularly connected to the top surface 25, where the plurality of position pins 29 is concentrically aligned with the plurality of pin holes 18. The plurality of position pins 29 is vertically inserted though the plurality of pin holes 18 and prevents back and forth rocking of the oscillating member 2 while allowing the oscillating member 2 to linearly move up and down within the base member 1. The pair of protrusions on each of the lateral walls also aligns with the pair of keyways of the first side rail 11 and the pair of keyways of the second side rail 13 in order to provide additional stability to the linear movement of the oscillating member 2. The plurality of position pins 29 can be made from, but is not limited to, steel, hard plastic, aluminum or any other type of high strength materials In reference to FIG. 6, the connector bolt 3 of the preferred embodiment comprises a thumb nut 31, a cylindrical body 32, a male screw thread 33, and a head extremity 34. The cylindrical body 32 is positioned in between the thumb nut 31 and the head extremity 34. The thumb nut 31, the cylindrical body 32, and the head extremity 34 are linearly connected to each other. The male screw thread 33 is spirally connected around the cylindrical body 32 similar to traditional bolts. The head extremity 34 comprises a conical shape where the conical shape is similar to the bottom conical section, but the dimensions of the head extremity 34 are slightly smaller than the bottom conical section. In reference to FIG. 10 and FIG. 11, the head extremity 34 is rotatably positioned within the bottom conical section in such a way that the cylindrical body 32 is positioned perpendicular to the top surface 25. The cylindrical body 32 is concentrically positioned within the hole 16, and a hidden section of the cylindrical body 32, which is adjacently positioned with the head extremity 34, is rotatably positioned within the top cylindrical section. The male screw thread 33 is rotatably engaged with the female screw thread 17, and the thumb nut 31 is positioned atop the rail connector plate 15. When the users rotate the thumb nut 31, the oscillating member 2 moves up and down where the up and down movements depend on the rotational direction of the thumb nut 31 and the length of the male screw thread 33 and the female screw thread 17. An outer surface of the thumb nut 31 may comprise a friction grip or engraved friction patterns so that the users can easily rotate the thumb nut 31 without any slippage. The connector bolt 3 can be made from any other type of high strength materials or combination of many such as, steel, hard plastic, and aluminum.

When base member 1 is placed on top of the resting surface and around the runs and drips, the oscillating member 2 can be lowered down to the top of the runs and drips. Then the runs and drips can be sanded down without damaging the surrounding paint areas of the runs and drips preventing paint breakthrough and repainting. Depending on the size of the runs and drips, different grit size sand papers may require for each process. Since the present invention removes the runs and drips parallel to the paint, smooth and even final paint layer without any runs and drips can be achieved.

Alternative embodiment of the present invention may comprise all of the components as the preferred embodiment except the second side rail 13. The removal of the second side rail 13 allows the alternative embodiment to completely sand down the runs and drips within corners of the resting surface as the bottom plate 21 completely extends up to the corners.

Although the invention has been explained in relation to its preferred embodiment, it is to be understood that many other possible modifications and variations can be made without departing from the spirit and scope of the invention as hereinafter claimed.

What is claimed is:

1. A sanding apparatus for removing runs and drips in paint comprises, a base member;

an oscillating member;

a connector bolt;

the base member comprises a first side rail, a second side rail, a rail connector plate, a hole, a female screw thread, and a plurality of pin holes;

the oscillating member comprises a bottom plate, a middle scratch-resistant layer, a bolt rotational cavity, and a plurality of position pins; and the connector bolt comprises a thumb nut, a cylindrical body, a male screw thread, and a head extremity.

2. The sanding apparatus for removing runs and drips in paint as claimed in claim 1 comprises, the first side rail being oppositely positioned from the second side rail;

the rail connector plate being perpendicularly connected atop to the first side rail and the side second rail;

the hole being centrally positioned through the rail connector plate;

the female screw thread being spirally positioned within the hole;

the plurality of pin holes being adjacently positioned with each corner of the rail connector plate; and the plurality of pin holes being traversed through the rail connector plate.

3. The sanding apparatus for removing runs and drips in paint as claimed in claim 2 comprises, the first side rail comprises a first scratch-resistant layer;

the first scratch-resistant layer being oppositely positioned from the rail connector plate;

the first scratch-resistant layer being adjacently connected to the first side rail;

the second side rail comprises a second scratch-resistant layer;

the second scratch-resistant layer being oppositely positioned from the rail connector plate; and the second scratch-resistant layer being adjacently connected to the second side rail.

4. The sanding apparatus for removing runs and drips in paint as claimed in claim 1 comprises, the bottom plate being positioned in between the first side rail, the second side rail, and the rail connector plate;

the bottom plate comprises a front end, a back end, a top surface, and a bottom surface;

the top surface being adjacently positioned with the rail connector plate;

the bottom surface being oppositely positioned from the top surface;

the front end and the back end being angularly positioned in between the top surface and the bottom surface;

the middle scratch-resistant layer being positioned in between the first side rail and the second side rail;

the middle scratch-resistant layer being adjacently connected to the bottom surface;

the bolt rotational cavity being centrally positioned on the top surface;

the plurality of position pins being concentrically aligned with the plurality of pin holes;

the plurality of position pins being perpendicularly connected to the top surface; and the plurality of position pins being vertically inserted through the plurality of pin holes.

5. The sanding apparatus for removing runs and drips in paint as claimed in claim 4 comprises, the top surface being a shorter length than the bottom surface.

6. The sanding apparatus for removing runs and drips in paint as claimed in claim 4 comprises, the front end comprises a plurality of sinkers;

the plurality of sinkers being equally spaced on the front end; and the plurality of sinker being connected to the front end.

7. The sanding apparatus for removing runs and drips in paint as claimed in claim 4 comprises, the back end comprises a plurality of sinkers;

the plurality of sinkers being equally spaced on the back end; and the plurality of sinker being connected to the back end.

8. The sanding apparatus for removing runs and drips in paint as claimed in claim 1 comprises, the cylindrical body being positioned in between the thumb nut and the head extremity;

the cylindrical body being linearly and concentrically connected to the thumb nut and the head extremity; and the male screw thread being spirally connected around the cylindrical body.

9. The sanding apparatus for removing runs and drips in paint as claimed in claim 1 comprises, the head extremity being rotatably positioned within the bolt rotational cavity, wherein the cylindrical body is positioned perpendicular to the top surface;

the cylindrical body being concentrically positioned within the hole; and the male screw thread being rotatably engaged with the female screw thread.

10. A sanding apparatus for removing runs and drips in paint comprises, a base member;

an oscillating member;

a connector bolt;

the base member comprises a first side rail, a second side rail, a rail connector plate, a hole, a female screw thread, and a plurality of pin holes;

the oscillating member comprises a bottom plate, a middle scratch-resistant layer, a bolt rotational cavity, and a plurality of position pins;

the connector bolt comprises a thumb nut, a cylindrical body, a male screw thread, and a head extremity;

the first side rail being oppositely positioned from the second side rail;

the rail connector plate being perpendicularly connected atop to the first side rail and the side second rail;

the hole being centrally positioned through the rail connector plate;

the female screw thread being spirally positioned within the hole;

the plurality of pin holes being adjacently positioned with each corner of the rail connector plate; and the plurality of pin holes being traversed through the rail connector plate.

11. The sanding apparatus for removing runs and drips in paint as claimed in claim 10 comprises, the first side rail comprises a first scratch-resistant layer;

the first scratch-resistant layer being oppositely positioned from the rail connector plate;

the first scratch-resistant layer being adjacently connected to the first side rail;

the second side rail comprises a second scratch-resistant layer;

the second scratch-resistant layer being oppositely positioned from the rail connector plate; and the second scratch-resistant layer being adjacently connected to the second side rail.

12. The sanding apparatus for removing runs and drips in paint as claimed in claim 10 comprises, the bottom plate being positioned in between the first side rail, the second side rail, and the rail connector plate;

the bottom plate comprises a front end, a back end, a top surface, and a bottom surface;

the top surface being adjacently positioned with the rail connector plate;

the bottom surface being oppositely positioned from the top surface;

the front end and the back end being angularly positioned in between the top surface and the bottom surface;

the middle scratch-resistant layer being positioned in between the first side rail and the second side rail;

the middle scratch-resistant layer being adjacently connected to the bottom surface;

the bolt rotational cavity being centrally positioned on the top surface;

the plurality of position pins being concentrically aligned with the plurality of pin holes;

the plurality of position pins being perpendicularly connected to the top surface; and the plurality of position pins being vertically inserted through the plurality of pin holes.

13. The sanding apparatus for removing runs and drips in paint as claimed in claim 12 comprises, the top surface being a shorter length than the bottom surface;

the front end comprises a plurality of sinkers;

the plurality of sinkers being equally spaced on the front end;

the plurality of sinker being connected to the front end;

the back end comprises a plurality of sinkers;

the plurality of sinkers being equally spaced on the back end; and the plurality of sinker being connected to the back end.

14. The sanding apparatus for removing runs and drips in paint as claimed in claim 10 comprises, the cylindrical body being positioned in between the thumb nut and the head extremity;

the cylindrical body being linearly and concentrically connected to the thumb nut and the head extremity; and the male screw thread being spirally connected around the cylindrical body.

15. The sanding apparatus for removing runs and drips in paint as claimed in claim 10 comprises, the head extremity being rotatably positioned within the bolt rotational cavity, wherein the cylindrical body is positioned perpendicular to the top surface;

the cylindrical body being concentrically positioned within the hole; and the male screw thread being rotatably engaged with the female screw thread.

16. A sanding apparatus for removing runs and drips in paint comprises, a base member;

an oscillating member;

a connector bolt;

the base member comprises a first side rail, a second side rail, a rail connector plate, a hole, a female screw thread, and a plurality of pin holes;

the oscillating member comprises a bottom plate, a middle scratch-resistant layer, a bolt rotational cavity, and a plurality of position pins;

the connector bolt comprises a thumb nut, a cylindrical body, a male screw thread, and a head extremity;

the first side rail being oppositely positioned from the second side rail;

the rail connector plate being perpendicularly connected atop to the first side rail and the side second rail;

the hole being centrally positioned through the rail connector plate;

the female screw thread being spirally positioned within the hole;

the plurality of pin holes being adjacently positioned with each corner of the rail connector plate; and the plurality of pin holes being traversed through the rail connector plate.

17. The sanding apparatus for removing runs and drips in paint as claimed in claim 16 comprises, the first side rail comprises a first scratch-resistant layer;

the first scratch-resistant layer being oppositely positioned from the rail connector plate;

the first scratch-resistant layer being adjacently connected to the first side rail;

the second side rail comprises a second scratch-resistant layer;

the second scratch-resistant layer being oppositely positioned from the rail connector plate; and the second scratch-resistant layer being adjacently connected to the second side rail.

18. The sanding apparatus for removing runs and drips in paint as claimed in claim 16 comprises, the bottom plate being positioned in between the first side rail, the second side rail, and the rail connector plate;

the bottom plate comprises a front end, a back end, a top surface, and a bottom surface;

the top surface being adjacently positioned with the rail connector plate;

the bottom surface being oppositely positioned from the top surface;

the front end and the back end being angularly positioned in between the top surface and the bottom surface;

the middle scratch-resistant layer being positioned in between the first side rail and the second side rail;

the middle scratch-resistant layer being adjacently connected to the bottom surface;

the bolt rotational cavity being centrally positioned on the top surface;

the plurality of position pins being concentrically aligned with the plurality of pin holes;

the plurality of position pins being perpendicularly connected to the top surface;

the plurality of position pins being vertically inserted through the plurality of pin holes;

the top surface being a shorter length than the bottom surface;

the front end comprises a plurality of sinkers;

the plurality of sinkers being equally spaced on the front end;

the plurality of sinker being connected to the front end;

the back end comprises a plurality of sinkers;

the plurality of sinkers being equally spaced on the back end; and the plurality of sinker being connected to the back end.

19. The sanding apparatus for removing runs and drips in paint as claimed in claim 16 comprises, the cylindrical body being positioned in between the thumb nut and the head extremity;

the cylindrical body being linearly and concentrically connected to the thumb nut and the head extremity; and the male screw thread being spirally connected around the cylindrical body.

20. The sanding apparatus for removing runs and drips in paint as claimed in claim 16 comprises, the head extremity being rotatably positioned within the bolt rotational cavity, wherein the cylindrical body is positioned perpendicular to the top surface;

the cylindrical body being concentrically positioned within the hole; and the male screw thread being rotatably engaged with the female screw thread.

* * * * *